United States Patent [19]

Rushefsky

[11] Patent Number: 4,965,635

[45] Date of Patent: Oct. 23, 1990

[54] DIGITIZER APPARATUS AND METHOD

[75] Inventor: Norman Rushefsky, Brighton, N.Y.

[73] Assignee: Eastman Kodak Company, Rochester, N.Y.

[21] Appl. No.: 365,332

[22] Filed: Jun. 13, 1989

[51] Int. Cl.[5] ..... G03G 15/00

[52] U.S. Cl. ..... 355/218; 355/202

[58] Field of Search ..... 355/202, 218, 244, 328; 354/4; 178/18, 19

[56] References Cited

U.S. PATENT DOCUMENTS

| | | | |
|---|---|---|---|
| 4,343,540 | 8/1982 | Berdat | 354/4 |
| 4,740,818 | 4/1988 | Tsilibes et al. | 355/239 |
| 4,814,552 | 3/1989 | Stefik et al. | 178/18 |
| 4,862,219 | 8/1989 | Yoshida et al. | 355/202 |
| 4,887,128 | 12/1989 | Jamali et al. | 355/202 |

*Primary Examiner*—Joan H. Pendegrass

*Attorney, Agent, or Firm*—Norman Rushefsky

[57] ABSTRACT

An area of an original document sheet is to be selected for special treatment during reproduction say by an electrophotographic reproduction apparatus. Prior to selecting the area, a copy of the document is made using one type of toner and an image of a grid or other coded pattern is superimposed on this copy using the same or a second type or toner. The second pattern serves as a digitizing grid for use in identifying the area for selective treatment. In one embodiment, the pattern is formed with magnetic toner while the image of the original is reproduced with nonmagnetic toner. Alternatively, the pattern may be formed with operator readable grid coordinates allowing the operator to review the reproduction while away from the copier to determine digitizing inputs that may be manually input. In a second alternative embodiment, the pattern is formed with a different colored toner or a fluorescent toner. A hand held wand is moved over the copy and points identified through pulses generated by displacement of the wand from an edge of the copy or by reading an optical code that is imprinted into the pattern. The wand includes switches allowing the operator to identify types of special treatment etc. as well as memory for storing the points selected. After digitizing of the document is completed, the wand is plugged into the copier and downloaded into the copier's logic and control unit for processing for copying of the original with selective area treatment.

13 Claims, 8 Drawing Sheets

CP
PRINT
GRID PRINT
SPECIAL PRINT
177
66
65
TO 144
131
FROM COPIER FIG.3
INPUT SIGNAL BUFFERS
140
STORED PROGRAM CONTROL
136
TEMPORARY MEMORY
132
CENTRAL PROCESSING UNIT
133
INPUT DATA PROCESSOR
142
TIMING AND CYCLE CONTROL
134
OUTPUT DATA STORAGE LATCHES
146
OUTPUT DRIVERS
148
INTERRUPT SIGNAL PROCESSOR
144
FROM 194
FROM CP
ELECTRONIC DATA GENERATOR
152
TO 144
135
25
35
194
g
X
X2
X1
Y
a
b
c
d
Y1
Y2
R
192
197
FROM 148
105
109
Y'
Y'2
Y'1
X'1
X'2
Y''2
Y''1

DIGITIZER APPARATUS AND METHOD

CROSS-REFERENCE TO RELATED APPLICATIONS

This application is related to U.S. application Ser. No. 07/365,580, filed on even data herewith in the name of George Tsilibes and entitled, "Apparatus and Method for Digitizing a Document For Selective Area Treatment."

BACKGROUND OF THE INVENTION

1. Field of the Invention

The present invention relates to reproduction apparatus and methods and more specifically to apparatus and methods for digitizing or identifying areas of documents for special treatment when reproducing same.

2. Brief Description of the Prior Art

In U.S. Pat. No. 4,740,818 electrophotographic reproduction apparatus is described in which a document original to be reproduced is placed upon an exposure platen and a wand used by an operator to select points on the original which define an area for selective treatment such as selective screening. Other known functions for reproducing the original include selective erase of certain areas of the original, selective coloration or accent coloring, selective annotation, etc. While the apparatus described in the aforementioned patent works well, it would be desirable to provide less costly alternatives.

It is, therefore, an object of the invention to provide an inexpensive digitizer for use in reproducing documents with selective area treatment.

SUMMARY OF THE INVENTION

A method and apparatus for reproducing documents employing a reproduction apparatus having a function for selective area treatment by digitizing a document to identify an area thereof for selective treatment. The original document is reproduced so that machine readable patterns are produced thereon to assist in defining area(s) selected for special treatment; and further reproductions are then made with selected area treatment.

BRIEF DESCRIPTION OF THE DRAWINGS

The subsequent description of the preferred embodiments of the present invention refers to the attached drawings wherein.

DETAILED DESCRIPTION OF THE PREFERRED EMBODIMENTS

Because electrophotographic reproduction apparatus are well known, the present description will be directed in particular to elements forming part of or cooperating more directly with the present invention. Apparatus not specifically shown or described herein are selectable from those known in the prior art.

Figure 1A:
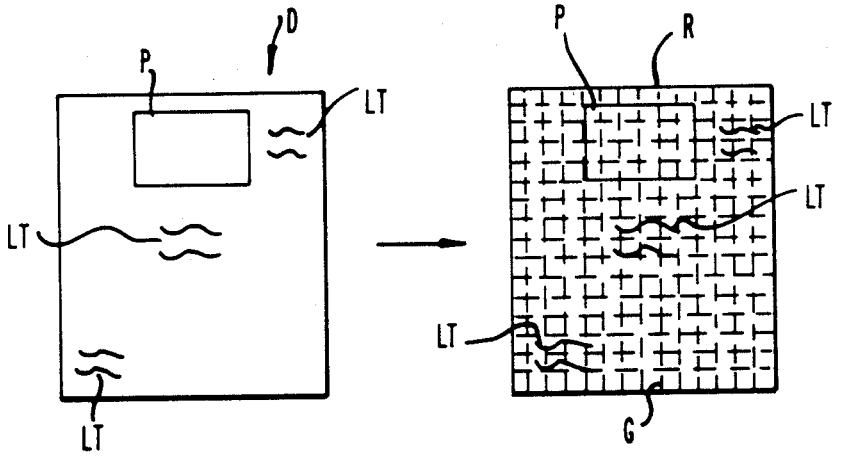
FIG. 1*a* is a sketch of an original document, D, to be reproduced and also a reproduction, R, thereof with a grid pattern added thereto to provide a machine readable grid for use in digitizing an area(s) thereof for selective area treatment.

With reference now to FIG. 1, a sketch is shown of an original document D to be reproduced. In the example to be discussed the original document D includes a continuous tone pictorial area P and other areas containing line-type information LT. In making reproductions of the original, it is desired to have in such reproduction area P formed in a halftone without introducing halftone-type modulation to the line-type area. In order to define the area P, a reproduction R is made of the original document D. The reproduction R includes a machine readable grid G in addition to the pictorial area P and line-type information LT. The reproduction is made using the electrophotographic reproduction apparatus of FIGS. 3–5.

Figure 3:
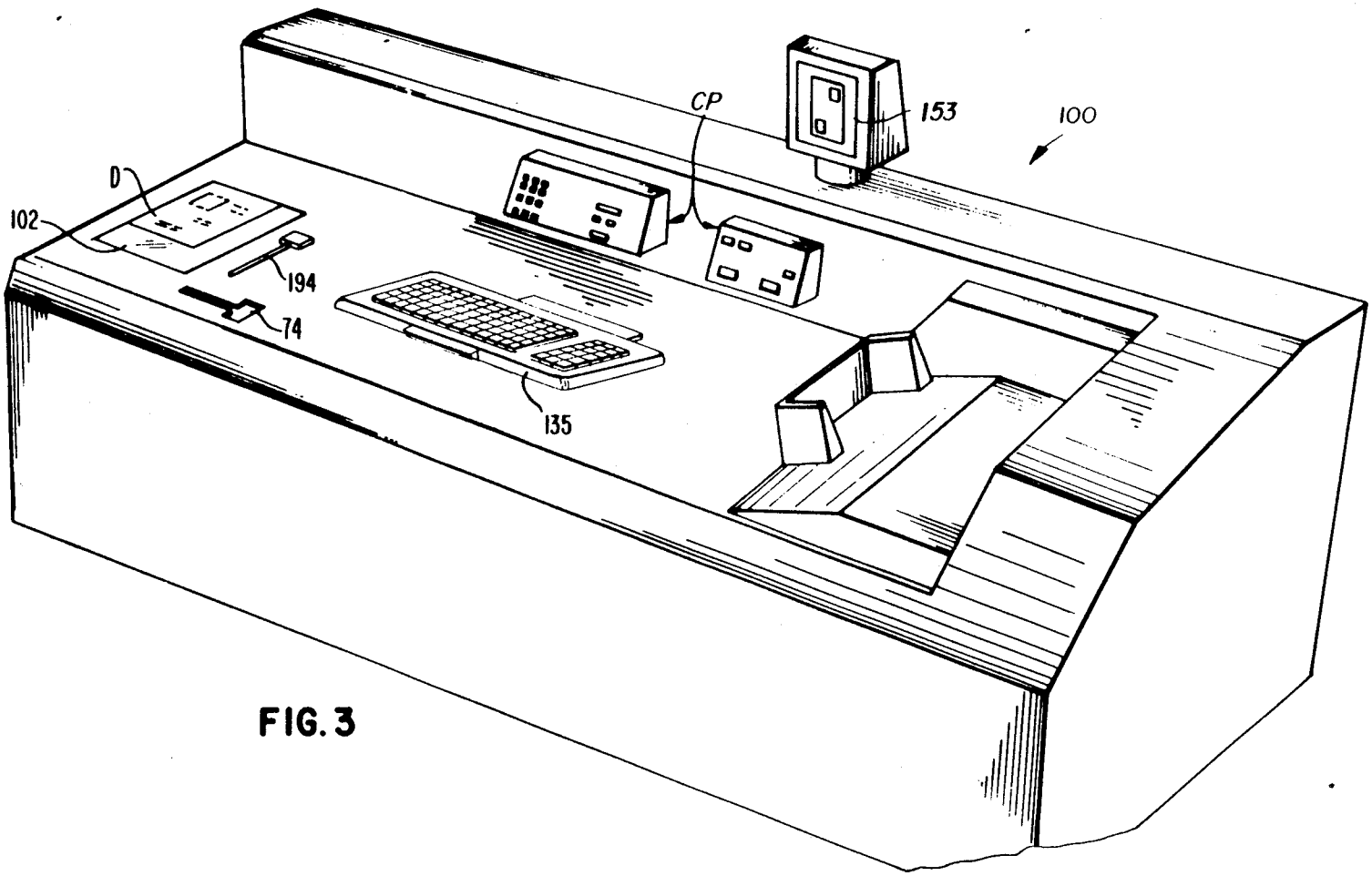
FIG. 3 is a perspective view of one embodiment of electrophotographic apparatus for practice of the present invention.
Figure 4:
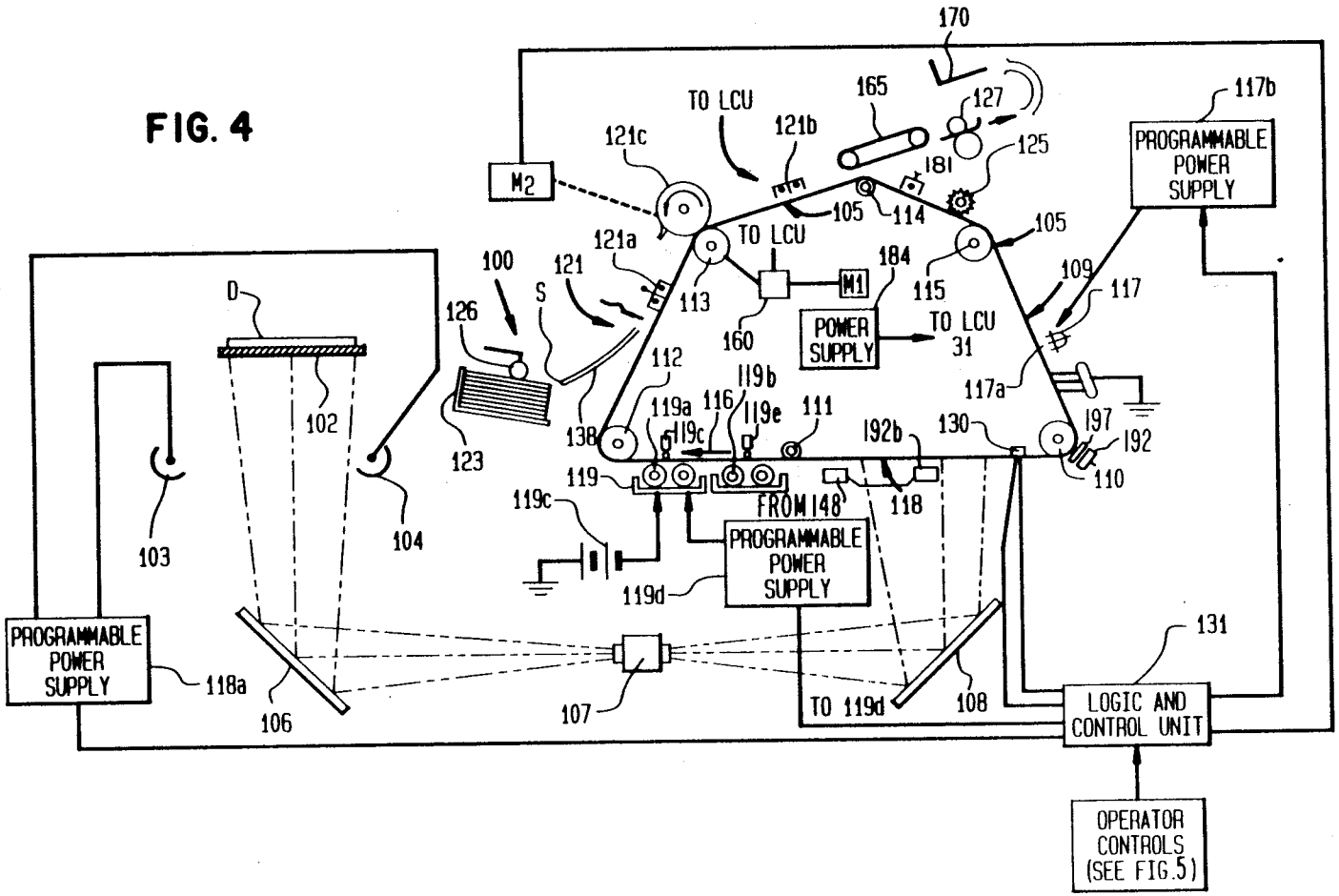
FIG. 4 is a schematic front elevational view of the apparatus of FIG. 3 and showing the general arrangement of electrophotographic reproduction apparatus that is in accordance with the invention.

Reference will now be had to FIGS. 3 and 4. An electrophotographic reproduction apparatus 100 includes a photoconductive web 105 that is trained about six transport rollers 110, 111, 112, 113, 114 and 115, thereby forming an endless or continuous web. Roller 113 is coupled to a drive motor Ml in a conventional manner. Motor Ml is connected to a source of potential when a switch (not shown) is closed by a logic and control unit (LCU) 131. When the switch is closed, the roller 113 is driven by the motor Ml and moves the web 105 in a clockwise direction as indicated by arrow 116. This movement causes successive image areas or image frames of the web 105 to sequentially pass a series of electrophotographic work stations of the copier.

For the purpose of the instant disclosure, several copier work stations are shown along the web's path. These stations will be briefly described.

First, a charging station 117 is provided at which the photoconductive surface 109 of the web 105 is sensitized by applying to such surface a uniform electrostatic primary charge of a predetermined voltage. The station 117 includes an A.C. corona charger. The output of the charger is controlled by a grid 117*a* connected to a programmable power supply 117*b*. The supply 117*b* is in turn controlled by the LCU 131 to adjust the voltage level Vo applied onto the surface 109 by the charger 117.

At an exposure station 118, a light image of a document sheet D, supported on transparent platen 102, is projected by mirrors 106, 108 and lens 107 onto the photoconductive surface 109 of the web 105. While the apparatus will be described with respect to reflection exposure of the original document sheet onto the photoconductive surface, the use of transmission exposures of an original is also contemplated by the invention. The projected image dissipates the electrostatic charge at the light exposure areas of the photoconductive surface 109 and forms a latent electrostatic image. A programmable power supply 118*a*, under the supervision of the LCU 131, controls the intensity or duration of light from flash lamps 103 and 104 to adjust the exposure level E incident upon the web 105. Two development stations 119*a* and 119*b* are provided. Each includes developer which may consist of iron carrier particles and electroscopic toner particles with an electrostatic charge opposite to that of the latent electrostatic image. Developer is brushed over the photoconductive surface 109 of the web 105 and toner particles adhere to the latent electrostatic image to form a visible toner particle, transferable image. The development station may be of the magnetic brush type with one or two rollers. One developer station 119*b* includes non-magnetic toner particles, the other station 119*a* includes metal containing toner particles such as the known MICR toner particles which are characterized by magnetic properties, i.e., these particles have a permeability to magnetic fields and are thus able to be detected by magnetic detectors. A suitable electrical bias to the station is provided by a programmable power supply 119*d*. Back-up rollers or the like 119*c* and 119*e* are provided and associated with a respective development station and selectively activated by LCU 131 to control which development station is to apply toner to the web 105.

The apparatus 100 also includes a transfer station 121 shown as a corona charger 121*a* at which the toner image on web 105 is transferred to a copy sheet S; and a cleaning station 125, at which the photoconductive surface 109 of the web is cleaned of any residual toner particles remaining after the toner images have been transferred. After the transfer of the unfixed toner images to a copy sheet S, such sheet is transported to a heated pressure roller fuser 127 where the image is fixed to the copy sheet S.

As shown in FIG. 4, a copy sheet S is fed from a supply 123 by a roller 126. The copy sheet may then be driven by continuous driven rollers (not shown) which then urge the sheet against a suitable registration mechanism (not shown). The copy sheet is then released and moves forward onto the web 105 in alignment with a toner image at the transfer station 121.

To coordinate operation of the various work stations with movement of the image areas on the web 105 past these stations, the web has a plurality of perforations along one of its edges. These perforations generally are spaced equidistantly along the edge of the web 105. For example, the web 105 may be divided into six image areas or image frames by F perforations, and each image area may be subdivided into 51 sections by C perforations. The relationship of the F and C perforations to the image areas is disclosed in detail in commonly assigned U.S. Pat. No. 3,914,047 filed in the name of Hunt, Jr. et al and issued Oct. 21, 1975. At a fixed location along the path of web movement, there is provided suitable means 130 for sensing web perforations. This sensing produces input signals into the LCU 131 which has a digital computer, preferably a micoprocessor. The microprocessor has a stored program responsive to the input signals for sequentially actuating then deactuating the work stations as well as for controlling the operation of many other machine functions as disclosed in U.S. Pat. No. 3,914,047. Additional encoding means 160 may be provided as known in the art for providing more precise timing signals for control of the various functions of the apparatus 100.

Programming of a number of commercially available microprocessors such as in INTEL mode 8086 microprocessor (which along with others can be used in accordance with the invention), is a conventional skill well understood in the art. This disclosure is written to enable a programmer having ordinary skill in the art to produce an appropriate control program for the one or more microprocessors used in this apparatus. The particular details of any such program would, of course, depend on the architecture of the designated microprocessor.

Figure 5:
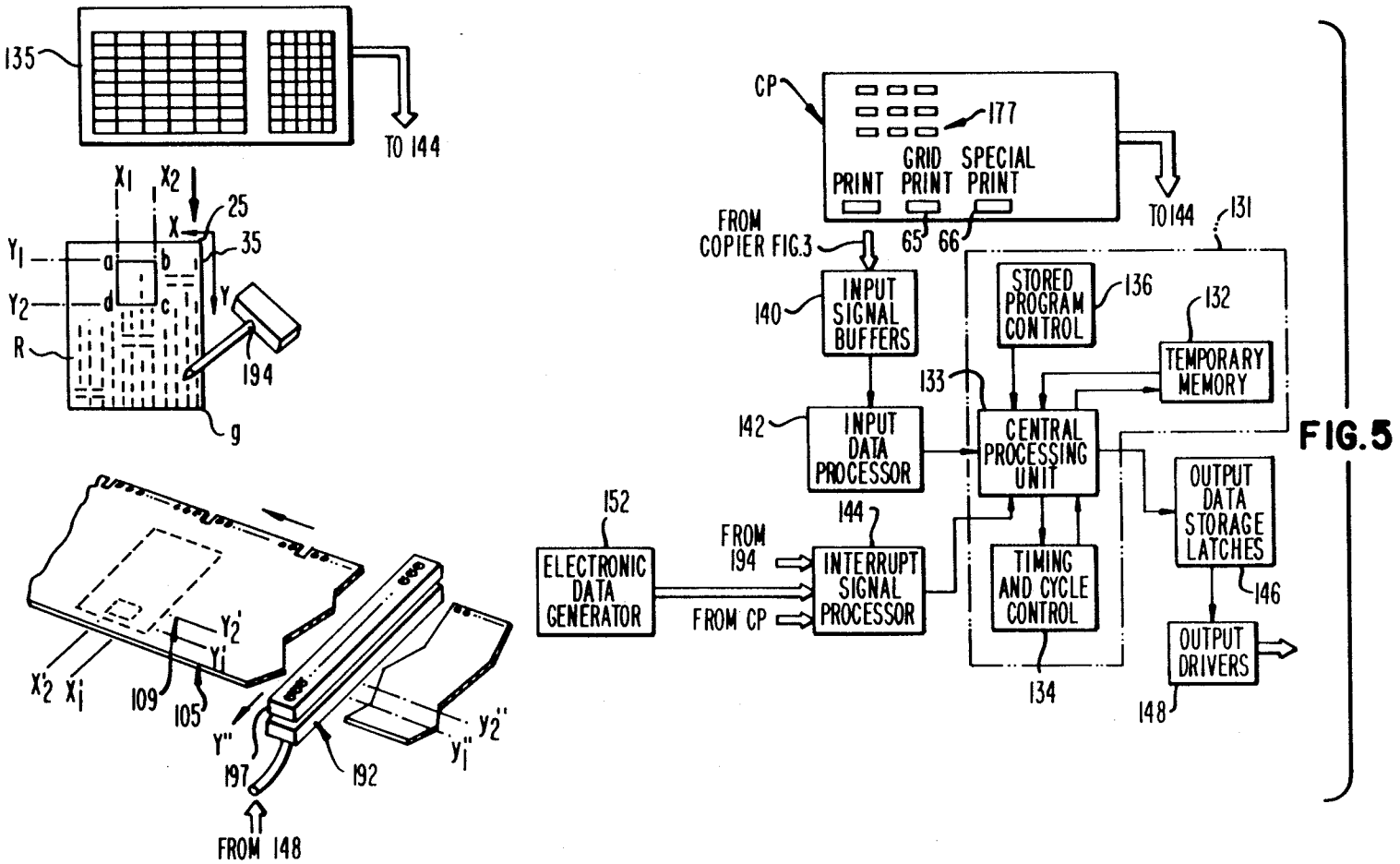
FIG. 5 is a schematic illustrating a data input station and block diagrams of controls for controlling the apparatus shown in FIG. 4.

With reference also now to FIG. 5, a block diagram of logic and control unit (LCU) 131 is shown which interfaces with the apparatus 100. A document feeding apparatus (not shown) may also be provided that includes known recirculating feeder and document positioner means. Details of a known document feeding apparatus may be found, for example, in U.S. Pat. No. 4,451,137, issued May 29, 1984 in the name of Farley.

The LCU 131 consists of temporary data storage memory 132, central processing unit 133, timing and cycle control unit 134 and stored program control 136. Data input and output is performed sequentially under program control. Input data are supplied either through input signal buffers 140 to an input data processor 142 or to interrupt signal processor 144. The input signals are derived from various switches, sensors and analog-to-digital converters. The output data and control signals are applied to storage latches 146 which provide inputs to suitable output drivers 148, directly coupled to leads. These leads are connected to the various work stations, mechanisms and controlled components associated with the apparatus. An electrical power supply (not shown) is provided to power the LCU 131.

Also shown in FIG. 5 is an operator control panel CP. In addition to the function key PRINT (for initiating normal copying) other keys 177 are provided for designating the number of copies. A grid print button 65 is provided for initiating a copying mode to be described for reproducing a reproduction R (FIG. 2*b*) from a normal original document D. A special print button 66 is also provided for initiating a special print operation wherein a selective area treatment is to be provided during reproduction. Document sheet D includes continuous tone pictorial information (or more generally—information to be reproduced with the selective screening process described herein) in the area defined by rectangle a,b,c and d and line-type information LT (such as alphanumerics, or generally information not to be reproduced with the selective screening process described herein) in the background areas.

The "GRID PRINT" button 65 on the control is used by the operator to initiate a special copying operation wherein a reproduction R of the document D is made with a grid pattern superimposed upon the information reproduced from the original. In making this reproduction, the original document, D, is placed face down upon the transparent glass exposure platen 102 in register with say a reference such as a corner of the platen. The copier grid print button 65 is then pressed and an optical exposure of an image frame of the electrically charged photoconductor 105 made by activating exposure lamps 103, 104. Prior to the LCU's providing signals to activate lamps 103, 104, an exposure of a grid pattern is made upon an adjacent image frame using an LED (light emitting diode) printhead 192. A program stored in stored program control 136 includes data for printing the grid pattern upon this adjacent image frame of web 105. The adjacent frame thus has its uniform charge modulated so that the charge remaining after exposure in the LED printhead represents a latent electrostatic image of a grid. The latent image of the grid is developed with the MICR toner in station 119*a*. After this adjacent image frame has passed the exposure station 118, the lamps 103, 104 are activated for making the exposure of the image on document D onto the next image frame. This image frame is also developed but with the non-metallic toner in station 119*b*. The two developed image frames are then transferred in register to the copy sheet S using transfer charger 121*a* to transfer the toner image of the grid to sheet S; transfer vacuum roller 121*c*, upon which the sheet circulates until in register with the next image frame; and transfer charger 121*b*, which transfers a reproduction of the image present on original document D to the copy sheet. The registered images are then transported by vacuum belt 165 to fuser rollers 127 which fix the images upon the copy sheet. Thus, a reproduction R is formed similar to that indicated in FIG. 1 and transported to output tray 170.

With the reproduction R now made, the operator may now take a digitizing wand and the reproduction R to a convenient location and identify the location(s) on the reproduction R of the area(s) selected for special treatment and the type(s) of special treatment desired for respective areas, i.e., selective screening, accent color, selective erase, selective annotation.

Details of the wand and apparatus and method for digitizing will now be discussed.

Figure 6:
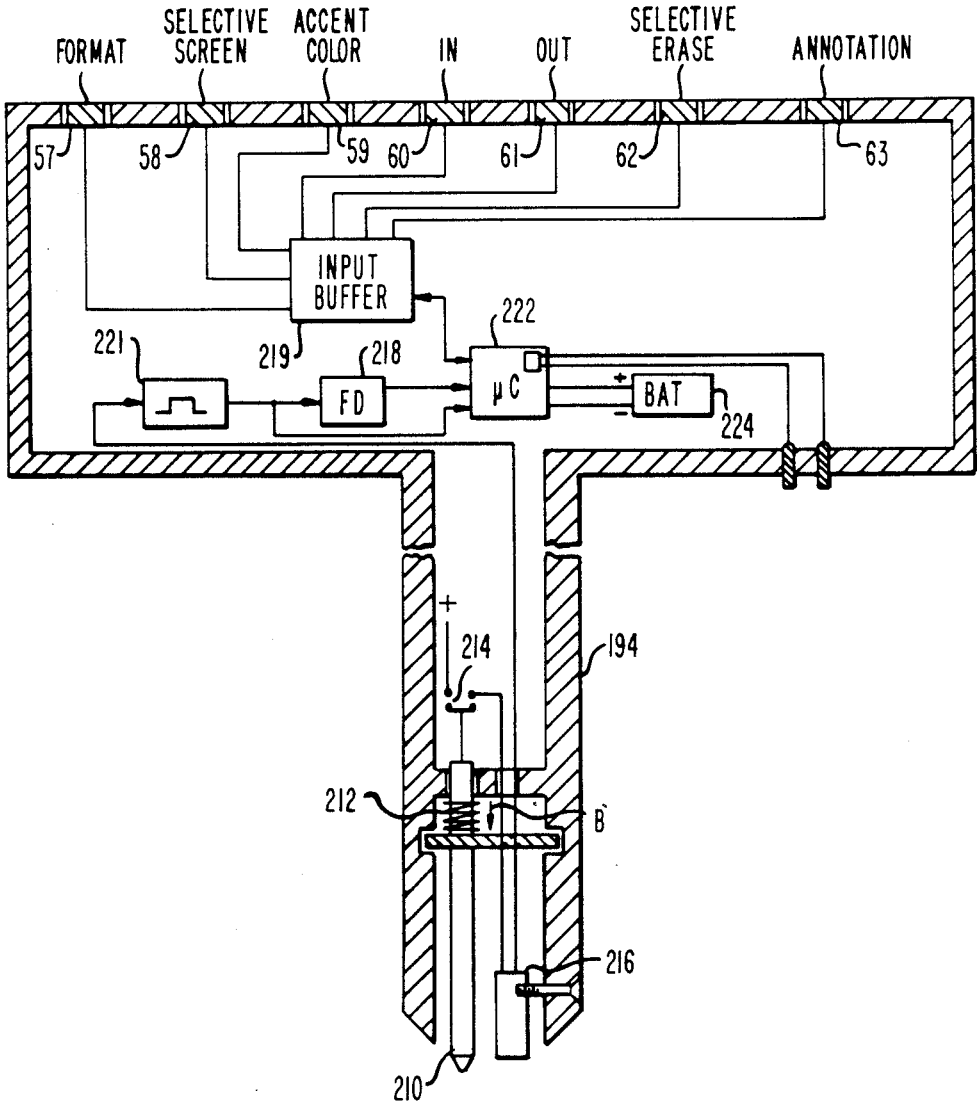
FIG. 6 is a schematic of a cross-section of a digitizing wand for use with one embodiment of the method and apparatus of the invention.
Figure 7:
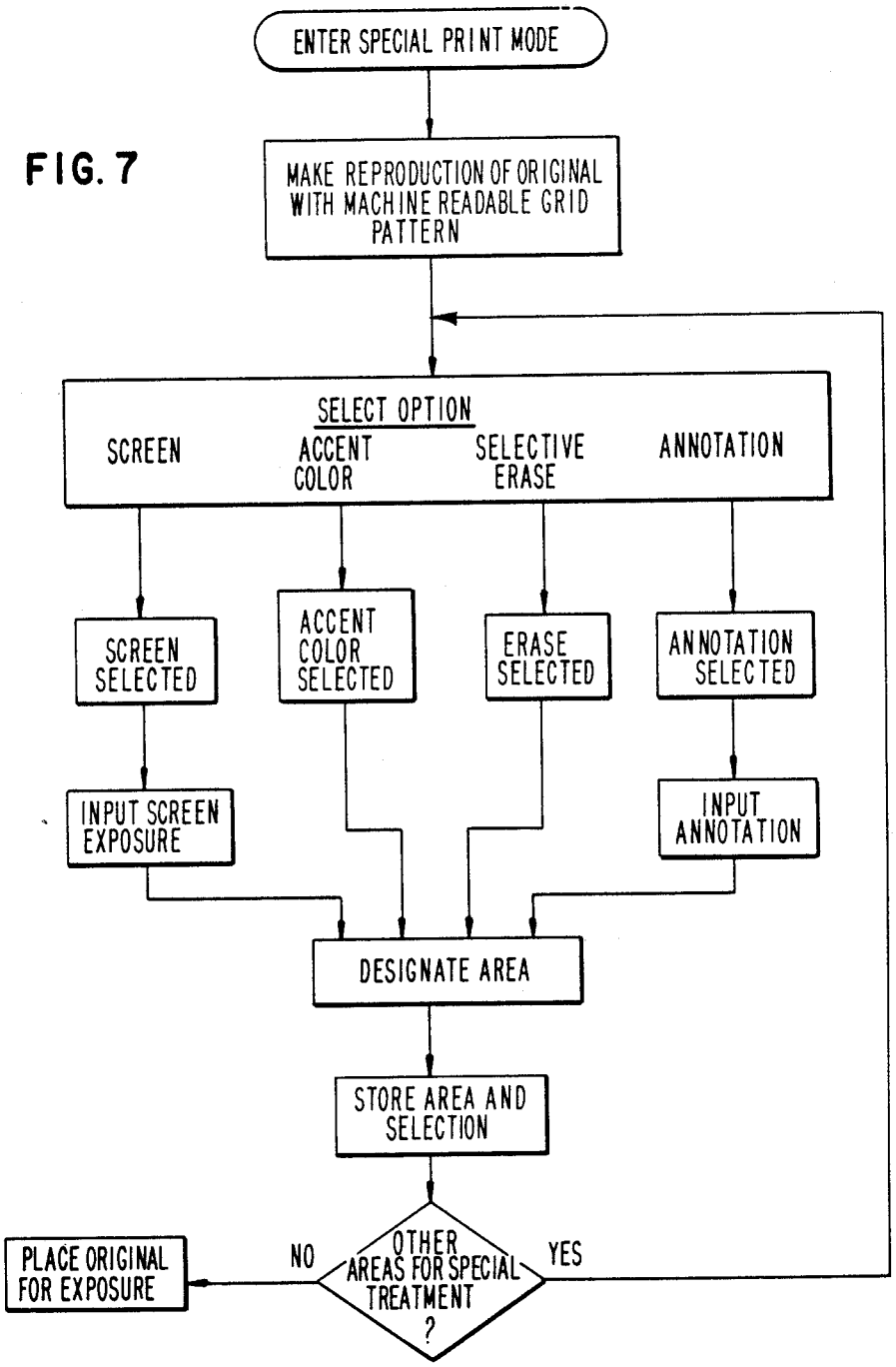
FIG. 7 is a flowchart illustrating the steps for operator selection of selective area treatments in accordance with the invention.

With reference now also to FIG. 6, wand 194 includes an ink-containing pen 210 that is biased by spring 212 in the direction shown by arrow B. Upon use of the wand by placement of the pen point upon the surface of the reproduction R, a switch 214 is closed which energizes a magnetic detection unit 216 in the wand. The head may comprise magnetic write and read units, the write unit impressing a magnetic polarization to the grid lines with the read unit adapted to detect same. Alternatively, the head may comprise a detection unit for detecting changes in magnetic permeability. In order to digitize or identify a point, the wand is placed at the top reference edge 25 of the reproduction R and the pen-point thereof moved over the sheet R along a vertical grid line in a direction parallel to a side reference edge 35. For example, with reference to FIG. 5 to digitize point "a" on reproduction sheet R, the wand 194 is moved from the reference edge 25 parallel to reference edge 35 until point "a" on sheet D is reached. In response to the magnetic detection portion of the wand traversing the horizontal magnetic grid lines on the reproduction R, pulses are generated and sent to the digitizer's logic electronics which counts the number of pulses and translates same into $Y_1$, one of the two coordinates for point "a". The other coordinate is determined similarly but by moving the wand from reference edge 35 parallel to reference edge 25 until point "a" is again reached. The pulses created determines the coordinate, $X_l$. The location of point "a" is thus identified. In like manner, each of the other coordinates requiring digitization or determination as to location relative to the corner reference (intersection of edges 25 and 35) is made. Alternatively, once the position of point "a" is defined relative to the corner reference the other points, b, c and d may be defined by movement of the wand along the perimeter of the rectangle to be formed in accordance with a prescribed protocol. Alternatively, the grid pattern may be distinguishable in the x and y directions by having the frequency of the grid lines be different in the different directions. For example, the magnetic grid pattern may be 2 lines/inch in one direction and 4 lines/inch in the other direction. With the wand moved at a relatively constant speed by the operator and starting at point a, the circuitry in digitizer 196 for translating the electrical pulse signals into coordinate data can determine directionality by discriminating the frequency of the pulses. Thus, changes in direction of movement of the wand are determined and a corner point of the rectangle defined at the location of the change of direction. The digitizer circuitry for detecting the points defined by the rectangle may comprise a pulse shaper and amplifier 221 for amplifying the pulse signals from the detection unit 216, a frequency discriminator 218 which senses the amplified pulses from the pulse shaper and generates a one-bit digital signal indicative of the frequency of the pulses; i.e., are the current pulses high or low, and thus indicative of direction of movement of the wand and a microcomputer 222 which is programmed to count the pulses from the amplified pulses and which receives the one-bit directional signal. Those signals are used by the computer to determine the positions of the various vertices of rectangle abcd. Power for the head is provided by a battery 224.

For the rectangular continuous tone pictorial area abcd shown, as noted above, the wand may be used to identify this area at the four corner points of this area. Preferably, the points are identified in an order such that a straight line joints adjacent points as in the order a,b,c, and d to define a rectangle. The computer control for the digitizing tablet may also be programmed to accept inputs of area data to define other geometrical shapes such as circles. The microcomputer 222 for the digitizing wand is programmed to recognize that the area is bordered by the straight lines joining adjacent points *a, b, c*, and *d* and the coordinates for the area to be selectively screened can be thus calculated and stored in temporary memory residing on the microcomputer. The coordinates for the points *a, b, c* and *d* would be $x_1$, $y_1$; $x_2$, $y_1$; $x_2$, $y_2$; and $x_1$, $y_2$, respectively. Alternatively, as known in the art, two diagonal corner points may be used to define the rectangle.

Prior to or after identifying the area to receive selective area treatment the operator will also select the function desired such as selective screening which is selected by depressing the input function button 58 which is on the wand. A signal is generated and stored in the memory on the microcomputer 222 that this is the selected area treatment to be performed. A buffer 219 may be provided to temporarily store signals from the button switches and feed them to the microcomputer 222 when requested. Further identification of the area may be made with use of the "IN" and "OUT" buttons 60, 61 with "IN" defining the treatment to be everywhere outside the area defined. Alternatively, the "IN" button may be deleted and the computer programmed to accept "IN" as a default condition unless "OUT" is otherwise selected. A format input button 57 may also be provided to allow the operator to designate the size of the reproduction R, i.e., 8½"×11" or 11"×14" by traversing the wand from one edge to the opposite edge and counting the pulses to determine each dimension. Alternatively, the reproduction R may have an imprinted reference spot that is recorded with the grid during the reproduction process and the location of points *a, b, c* and *d* made relative to this reference spot.

After the information is provided concerning areas *a, b, c* and *d*, the operator may repeat this operation for additional areas to be specifically treated for reproduction of this document. Assuming this information is input, the operator then places the wand into the copier in the recess 74 provided therefor. With the wand selected properly within the recess plug terminals 68 engage a complimentary socket in the copier recess and the information stored on the wand is downloaded to the copier's logic and control unit 131.

The ICU 131 processes this data and outputs same to the display screen 153 which displays the selection. The operator then takes the original document D and places same face down in a registered position upon the exposure platen 102. Suitable logic or computing means may be provided in the digitizer or LCU 131 to translate the data points determined during the digitizing step for a plane formed by axes X, Y in the plane of the reproduction R to that of X', Y' on an image frame of the photoconductor's surface 109.

As previously described, image exposure is effected by flash lamps 103 and 104, which form a latent electrostatic image of the document sheet upon an image frame of the web. Formation of a plurality of charge islands within the latent electrostatic image is effected by a second exposure upon the web by an LED printhead 192. This second exposure may be carried out prior to, simultaneous with, or after image exposure of the photoconductor, the only requirement being that this second exposure be carried out after charging by primary charger 17 and prior to development.

With reference again to FIG. 3, there is shown the printhead 192 for simulating a screen-like exposure upon the web. The printhead 192 comprises a plurality of light-emitting diodes (LED's) arranged in a row. These LED's are coupled to the output drivers 148 of the LCU 131. Optical fibers are associated with the LED's for imaging light from the LED's onto the photoconductor. Such fibers may be arranged as a conventional gradient index lens array (GRIN) 197, such as a SELFOC (trademark of Nippon Sheet Glass Co., Ltd.) array.

Prior to or as the frame on the photoconductive web upon which the image of the document sheet is to be formed passes above the printhead, the LCU calculates which of the LED's to illuminate and the duration of such exposure. As shown in FIG. 5, the portions of the printhead between the ordinates $y''_1$, $y''_2$ on the Y'' axis of the linear printhead correspond to their respective counterparts on the original document and to their respective ordinate counterparts $y'_1$, $y'_2$ and on the y' axis of the image frame. These ordinate pairs each define a transverse line past which the respective latent electrostatic continuous tone image area on the photoconductor will be imaged. When this area, which corresponds to that for reproduction of the continuous tone information, begins to pass directly above the printhead, the appropriate LED's are illuminated by the LCU. The illumination provided by the selected LED's is created by a series of pulses to them so that light from the LED's forms a simulated screen pattern upon the area of the image frame corresponding to rectangle a,b,c and d. The parameters for determining the timing of when to commence pulsing of the LED's and when to terminate same are provided by the abscissa pairs $x'_2$, $x'_1$ of the image frame, respectively. Thus, when the portion of the image frame corresponding to the transverse line $x'_2$, as determined by signals provided by the LCU, underlies the printhead the LED's providing illumination between $y''_1$ and $y''_2$ commence to be rapidly pulsed. This pulsing lasts until the transverse line $x'_1$ (also determined by the LCU passes by the printhead.

Thus, a latent electrostatic image of a screen pattern is imaged upon the charged web by the second exposure source substantially only in the area of the image frame upon which the continuous tone image is to appear and, importantly, no screened exposure is provided outside of this area. The image of the document D is subsequently in this example superimposed upon the same image frame by activation of flashlamps 103, 104 to further modulate the electrostatic charge. The charged image pattern is then developed with the appropriate colored toner by actuation of the back-up roller **119*e* of developer station 119*b***, and the developed image from transformed to a receiver sheet S' as described above. There is thus provided a reproduction with an area thereof that has been selectively treated vis-a-vis that of the original.

While the invention has been described with regard to one type of array using an LED light source, it will be appreciated that others may be substituted. For example, a laser exposure may be substituted for the LED's.

While the invention has been described in terms of selectively screening an area in accordance with techniques more fully described in U.S. Pat. No. 4,740,818, the contents of which are incorporated herein, the invention is directed broadly to selective area treatment in reproducing documents and may include selective erase of information from areas of a document original, accent coloring, annotation etc.

In selective erase an area of the document is designated and the erase source such as an LED eraser or printer, used to expose selected areas of the electrostatically charged photoconductor's image frame used to reproduce this document. These areas generally border the image area(s) that is to be saved and do not receive toner when the image frame is developed. The respective button 62 on the wand and labelled "ERASE" is used for selecting this option as well as buttons labelled "IN" or "OUT" for identifying the area to be erased; i.e., is the area to be erased within or without the area selected. In the selective erase mode, the appropriate LED's are driven so that their exposures overlap to erase charge completely or at least to a level below which development can occur in those areas to be erased.

In accent coloring, selected via the "ACCENT COLOR" button 59, two image frames may be employed with the copier having two development stations with different colored toners. The original is exposed onto the two image frames and the LED printhead erases selected areas from each image frame. The unerased areas in each image frame are developed with respective colored toners and the developed two image frames transferred in register to the same surface of a copy sheet. Where accent color is selected, the copier may be provided with a third station having toner of a different color from the other stations. Alternatively, where only two stations are provided, the MICR toner station may be removed and an accent color station inserted or one station may be an accent color station and the other station carrying MICR toner may serve as the normal black toner station.

In selective annotation, selected via the "ANNOTATION" button 63, an area of an original may be blocked from the optical exposure and selected information written by the LED printhead into the area of the photoconductor's image frame that has been blocked. An electronic data generator 152 may be provided to supply the data signals to be printed. As may be noted to schematically in FIG. 4, a masking 192*b* may be moved into the optical exposure path either by operation of a solenoid or motor in response to signals from the LCU 131.

Figure 1B:
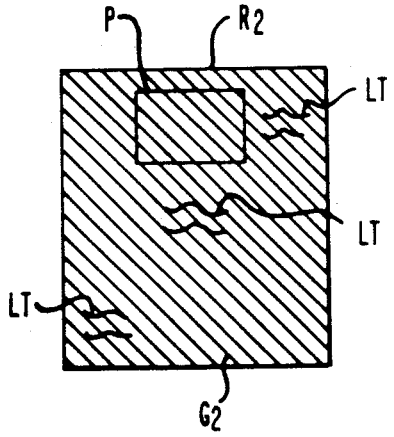
FIG. 1*b* is a sketch of an alternative embodiment showing a reproduction $R_2$ with a grid pattern $G_2$ whose lines are at a 45 degree angle with the edges of the page.

In the embodiment of FIG. 1*b*, the grid pattern G2 of magnetic toner is reproduced so that the lines thereof are all parallel and at an angle of 45 degrees with the edges of the page. The magnetic detection unit will respond to movement over this page when moved parallel to the edges of the page in accordance with a predetermined protocol for movement.

While the invention has been described with reference to an optical exposure system, it is contemplated that all exposures may be carried out by an electro-optical source such as an LED printhead or laser or other device wherein the selective area treatment is accomplished by modifying the data that is printed by the electro-optical source.

The invention, in its broader aspects, is not limited to electrophotography, but may also find utility in other applications where selective reproduction is desired for example, ink jet, thermal printing, etc. wherein the original image of the document is electronically scanned and only a selected area printed based upon inputs provided by the operator during the digitizing process.

The invention has been described with reference to forming a reproduction of an original and printing thereon a magnetic grid pattern; however, in its broader aspects other sheets such as those that may be optically detected may also be suitable with a corresponding change in the sensor unit to a photosensor or the like.

Figure 2A:
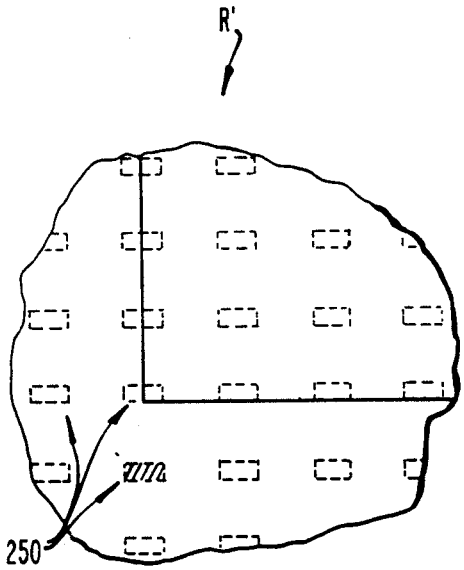
FIGS. 2*a* and 2*b* are respective sketches shown greatly enlarged of reproductions R′ and R″ with machine readable and operator readable data added thereto for use in digitizing areas thereof for selective area treatment.
Figure 8:
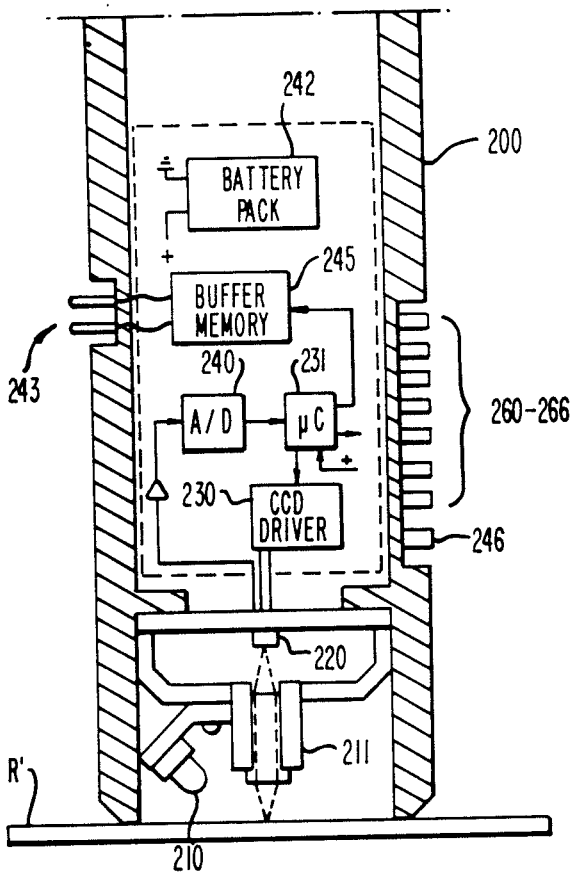
FIG. 8 is a schematic of another digitizing wand for use with the methods and apparatus of the invention.

In this regard, reference will now be made to FIGS. 2*a* and 2*b* and to FIG. 8 wherein a wand 200 is illustrated. In this embodiment, an original document, D, is to be reproduced with selective area treatment reproduced in a grid print mode as described above except in this mode the grid has a code printed into it, i.e., each point of the grid may be read to define that point without resort to movement from a side edge. For example, each point 250 may have its own bar code or microcode that identifies the coordinates of that grid point. The bar code may be magnetic or optical. In its preferred form, it is optical either as a bar code or character code. This code is printed by the LED printhead 192 during a grid print reproduction of document D when forming of reproduction R'. The code can be formed in a different color than that used to reproduce the information of document D onto reproduction, R'. This color differentiation allows the wand is distinguish between the original information and the coded information by being biased to be sensitive to one color. It may be desirable to add a UV fluorescent compound to one of the color stations to facilitate reading of the code by a UV light source on the wand. Alternatively, where only one toner station is present, the code may be read in an adjacent area wheren no print is present representing information from the original document, D. Usually the major portion of a document is white background and the printed area of an original constitutes only a small part of the area. There will thus be many points adjacent a printed area that will not be covered with information from the original.

The wand 200 includes a light source 210 which directs light at the point to be digitized. A lens such as a Selfoc lens 211 may then focus the reflection from this point to a photosensor such as a CCD array 220. The array 220 is driven by a driver 230 and the signals from the array 220 are fed to an analog/digital converter 240 and then input to a microcomputer 241. The computer includes a program to translate this code into a set of coordinate point which are stored in buffer memory 245. A battery pack 242 provides the electrical energy required for this operation. The contents of the buffer memory may be downloaded via terminals 243 to the copier when placed in a recess on the copier similar to recess 74 as described above. Each of the points of the rectangle *a, b, c, d* (or alternatively diagonal points say *a, c*) are thus digitized by placement of the wand at the appropriate corner points. The wand 200 also includes the function selection buttons 260–266 as described for wand 194. An additional button 246 may be provided to produce a signal to the microcomputer to initiate a reading of a point. This is in lieu of the pressure sensitive pen point described for wand 194. With the needed points of the document digitized to define the coordinates of the area selected for special treatment, the original document, D, is placed on the platen in registered position and a reproduction made as described above with selective screening, accent color, selective erase or selective annotation.

Figure 2B:
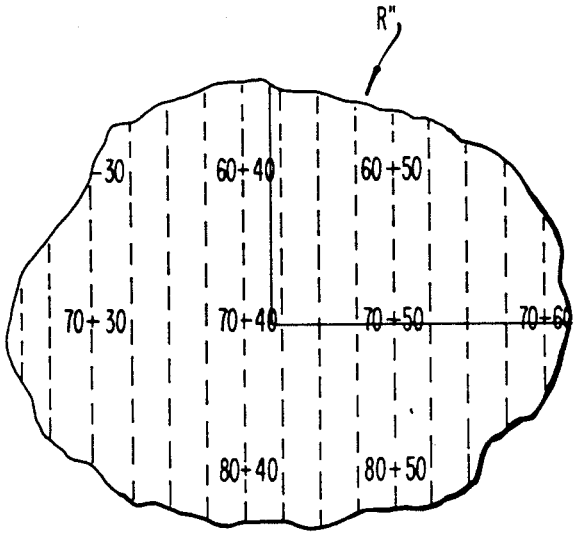

With reference now to the reproduction R" shown in FIG. 2*b*, the code reproduced is visually readable and digitization may be provided without a wand. The visual code is printed upon a reproduction R" when the grid button is pressed and original document, D, located in a registered position on the platen. The code is printed by the printhead 192 in response to signals from the data generator 152. The code is printed on one image frame and the document, D, reproduced on a second image frame. The two image frames may be developed with the same or different colored toners and transferred in register onto a copy sheet to form the reproduction R". The control panel CP will have a key pad 177 allowing an operator to identify the coordinates by pressing appropriate buttons. Thus, the corner point shown in FIG. 2*b* may be represented by coordinates 70, 40. These numbers may be input by the operator into the key pad 177. The LCU 131 then operates the copier 100 to provide the desired selective area treatment which have been input by the operator through the same key pad buttons on the control panel CP. By pressing a star button * on the key pad the LCU 131 will now accept a numerical input as a code for a particular selective area treatment. The reproduction with selective treatment will then be made in accordance with techniques described above.

To facilitate the reading of the code the reproduction of the original document, D, on R" may be made relatively lighter so that it is visible but not obscuring of grid code information.

While electrophotographic reproduction apparatus is shown as an optical copier, the invention may be practiced with electronic copiers wherein the original document is scanned electronically and then printed. In such copiers, a scanner that may include a CCD device is provided that "reads" the level of grey on the original line by line. This information is then processed, stored in memory, and printed out onto the appropriate image frame by an electronic printer such as the LED printhead 192 or laser printer. For selective area treatment, the digitizing data may be combined electronically with the data representing the image signals of document D, to be processed together electronically. Since the data on the original document may be stored electronically in a memory, the step of reproducing the original with selective area treatment may be accomplished without the need to scan the original a second time.

Although the above detailed description has been made with particular reference to a preferred embodiment, it will be understood that variations and modifications can be effected within the spirit and scope of the present invention.

I claim:

1. In a method of reproducing documents employing a reproduction apparatus, having a function for selective area treatment, by digitizing a document to identify areas thereof for selective treatment by said apparatus, said method comprising the steps of:

placing the original to be reproduced upon a support of said apparatus;

exposing the original to form a latent image thereof upon a recording element;

toning the image to develop the latent image into a visible copy image reproduction of the original;

transferring the copy image to a receiver sheet, and characterized by forming a second toner image upon the receiver sheet in register with the copy image, the second toner image defining a pattern for use in digitizing the copy image for selective area treatment.

2. The method of claim 1 and further characterized by the steps of moving a wand over the area of the pattern, the wand creating signal pulses corresponding with movement or the position location over said pattern, and in response to said signal pulses generating data signals indicative of the area selected for special treatment.

3. The method of claim 2 and wherein the original is placed upon the support, the original is again exposed to form a latent image on the recording element of at least a portion of the image upon the original, and in response to said data signals a selective area treatment is provided during this reproduction of the original and the image of the reproduction is produced with a selective area treatment to differentiate this reproduction from the original.

4. The method of claim 2 and wherein in the steps of exposing electronic image signals are generated related to image content of at least portions of the original, said image signals are stored in memory and wherein in response to said image signals stored in memory and data signals a latent image of at least a portion of the image of the original is made and a reproduction produced with a selective area treatment.

5. The method of claims 1, 2, 3 or 4 and wherein the selective area treatment comprises erasing a portion of the original image.

6. The method of claim 5 and wherein the second toner image is formed with magnetic toner.

7. The method of claim 5 and wherein the second toner image is spectrally distinguishable from the first toner image.

8. The method of claims 1, 2, 3 or 4, and wherein the selective area treatment comprises coloring a portion of the reproduction with a different color than the original.

9. The method of claim 8 and wherein the second toner image is spectrally distinguishable from the first toner image.

10. The method of claims 1, 2, 3 or 4 and wherein the second toner image is in coded form so that a reading of any point on the pattern itself defines the location of that point.

11. The method of claim 2 and wherein the wand is unconnected from other devices and stores the data signals in its own memory, the wand thereafter being connected to the reproduction apparatus for downloading the data signals to the reproduction apparatus.

12. In an apparatus for reproducing documents with selective area treatment; said apparatus comprising:

means for reproducing an original document having information thereon with a machine readable pattern in addition to the information present on the original document;

means for reading the pattern on the reproduction to define an area selected for special treatment and generating signals in response to said reading; and means responsive to said signals for producing the further reproduction of the original document with the further reproduction differing from the original in accordance with the selected treatment.

13. In an apparatus for reproducing documents with selective area treatment; said apparatus comprising:

means for exposing an original to form a latent image thereof upon a recording element;

means for toning the image to develop the latent image into a visible copy image reproduction of the original;

means for transferring the copy image to a receiver sheet, and characterized by forming a second toner image upon the receiver sheet in register with the copy image, the second toner image defining a pattern for use in digitizing the copy image for selecting area treatment.

* * * * *